United States Patent [19]

Krug

[11] 4,397,464

[45] Aug. 9, 1983

[54] COLLAPSIBLE BASKETBALL GOAL APPARATUS

[75] Inventor: Frank R. Krug, Newburgh, Ind.

[73] Assignee: Indian Industries, Inc., Evansville, Ind.

[21] Appl. No.: 299,295

[22] Filed: Sep. 3, 1981

[51] Int. Cl.[3] ..... A63B 63/08

[52] U.S. Cl. ..... 273/1.5 R

[58] Field of Search ..... 273/1.5 R; 248/548, 248/549; 172/271; 280/449; 180/14.5

[56] References Cited

U.S. PATENT DOCUMENTS

| | | | |
|---|---|---|---|
| 1,086,492 | 2/1914 | Weaver | 172/271 |
| 1,090,134 | 3/1914 | Caughey | 172/271 |
| 1,207,146 | 12/1916 | Dickinson | 172/271 |
| 2,381,973 | 8/1945 | Ego | 172/271 |
| 3,603,588 | 9/1971 | Ebstein | 273/1.5 R |
| 4,111,420 | 9/1978 | Tyner | 273/1.5 R |
| 4,194,734 | 3/1980 | Tyner | 273/1.5 R |

OTHER PUBLICATIONS

Slam Dunk Rim, Inc. Advertising Circular #2 Pop Bolt 4-1978.

Western Front 9-1977 Slam Dunk Rim.

*Primary Examiner*—Paul E. Shapiro

*Attorney, Agent, or Firm*—Woodard, Weikart, Emhardt & Naughton

[57] ABSTRACT

A collapsible basketball goal apparatus is disclosed herein which includes a backboard and a basketball hoop mounted to the backboard. The hoop is mounted to the backboard to be pivotable about a horizontal axis parallel with the backboard between a first, horizontal position and a second, downwardly-displaced position.

A post extends perpendicularly outward from the backboard and defines an aperture extending parallel to the backboard. An upper support is secured to the hoop and defines a hole in which the post is received in the first position. A shear member is positioned in the aperture of the post and is located to be sheared upon application of a downward force on the hoop which urges the upper support member away from the backboard to shear the member.

5 Claims, 4 Drawing Figures

COLLAPSIBLE BASKETBALL GOAL APPARATUS

BACKGROUND OF THE INVENTION

1. Field of the Invention

The present invention relates to the field of basketball goals, and particularly to a goal which is collapsible upon application of a sufficient downward force.

2. Description of the Prior Art

Many types of basketball goals have been provided in the prior art. The typical structure includes a round hoop portion which is secured to a bracket adapted for mounting on a basketball backboard. These structures are usually rigid in construction, with the pieces typically being welded together to form a single unit.

One problem which has developed is that the basketball goals and/or the backboards may not be sufficiently strong to withstand the downward forces applied by the players. Relatively strong forces may occur when a player "dunks" a basketball, or otherwise grabs onto or hangs on the rim or hoop portion of the basketball goal. One method to compensate for this problem has been to design heavy duty backboards and goals.

Another approach has been to design energy-absorbing basketball goals and backboard units. One such unit is described in U.S. Pat. No. 4,111,420, issued to Tyner on Sept. 5, 1978. The Tyner device includes a backboard which is pivotally mounted at the top and which has a spring mount at the bottom to permit the backboard to pivot inwardly so as to accommodate a downward force on the basketball goal.

An energy absorbing basketball goal and backboard unit is also described in U.S. Pat. No. 4,194,734, issued Tyner on March 25, 1980. In the latter patent, the backboard unit includes a basketball goal which is mounted to the backboard to be pivotable about a horizontal axis at the lower end of the mounting position. The upper portion of the bracket is secured to the backboard by bolts which extend through the backboard and connect to a spring mechanism. When a downward force is applied to the goal, the goal will pivot about the lower axis and the upper portion will move away from the backboard against the resistance of the spring biasing mechanisms.

In U.S. Pat. No. 3,603,588, issued to Ebstein on Sept. 7, 1971, there is disclosed a basketball goal which also is pivotable with respect to the backboard. However, the goal in the Ebstein patent pivots about a horizontal axis at the uppermost portion of the mounting bracket, with the lower portion being affixed by rigid struts connecting with the rim or hoop portion. The Ebstein goal therefore does not permit the goal to pivot downwardly in response to a downward force, but simply permits the goal to be collapsed in the downward position when the lower struts are disconnected from the backboard.

SUMMARY OF THE INVENTION

In one aspect of the present invention there is provided a collapsible basketball apparatus which includes a backboard and a basketball hoop secured to the backboard. Mounting means are provided to provide the hoop with a first position with the hoop or rim in a horizontal condition and a second position displaced downwardly therefrom. Release means are also provided for releasing the hoop from the first to the second positions in response to a downward force upon the hoop, the release means including a shear member positioned to be sheared by movement of the hoop from the first to the second positions.

It is an object of the present invention to provide a basketball goal apparatus which is simple and sturdy in construction, and which is relative inexpensive to manufacture.

A further object of the present invention is to provide a basketball goal apparatus which includes a collapsible basketball hoop, which will collapse in response to a downward force on the hoop.

It is another object of the present invention to provide a collapsible basketball hoop which includes a shear member which will shear to permit the hoop to collapse, which shear member may be selected to shear at various predetermined forces and which may be readily replaced to restore the basketball hoop to the use condition.

Further objects and advantages of the present invention will become apparent from the description of the preferred embodiment which follows.

DESCRIPTION OF THE PREFERRED EMBODIMENT

Figure 1:
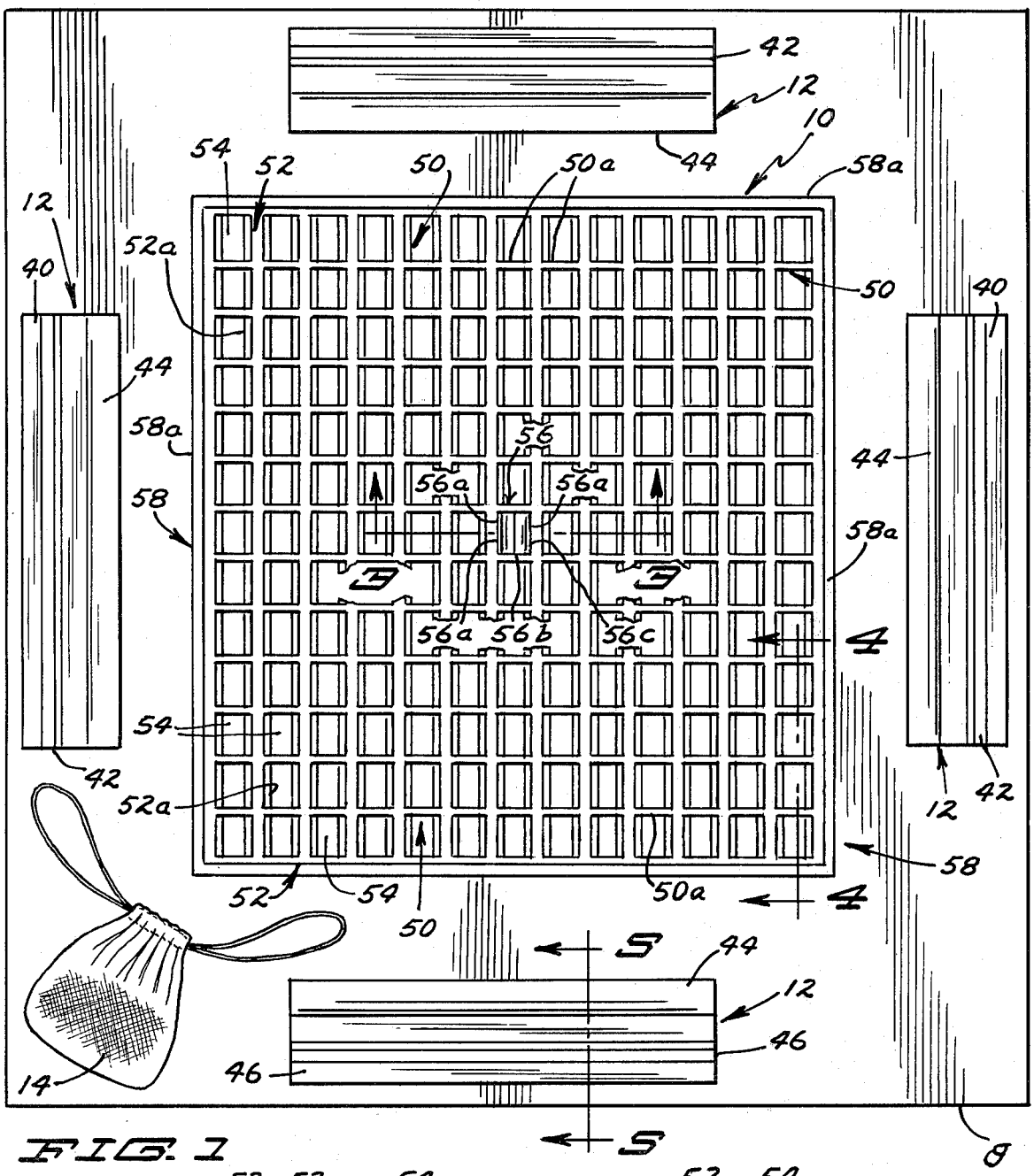
FIG. 1 is a perspective view of a basketball goal apparatus constructed in accordance with the present invention.
Figure 3:
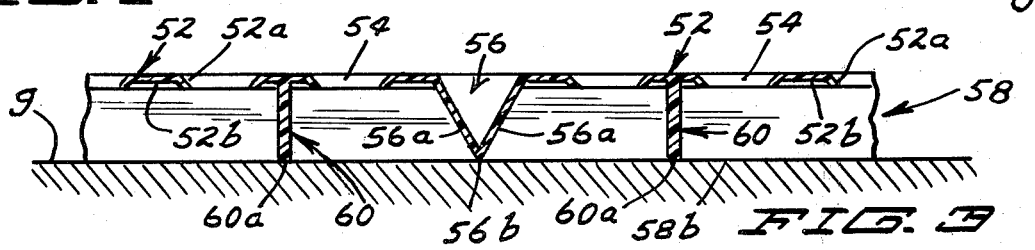
FIG. 3 is a cross-sectional view of the basketball goal apparatus of FIG. 1, and particularly showing the preferred embodiment for the mounting and release means.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides a collapsible basketball goal apparatus which will collapse from a horizontal position to a downwardly-extending position in response to a downward force applied to the basketball hoop or rim. It has increasingly become a problem that rigidly mounted basketball goals cannot sustain the repeated impacts prevalent in the game of basketball. Many times during each basketball game the rim portion of the basketball goal will either be grasped by a player during a shot or rebounding, or will be actually impacted by a substantial downward force when the player is "dunking" the basketball. Such repeated forces have resulted in failures of the basketball goals, and in some instances has resulted in substantial or total damage to the backboard to which the goal is mounted. The present invention therefore provides a basketball goal apparatus which will collapse in response to these downward forces, thereby preventing substantial damage to the basketball goal and/or backboard.

Referring in particular to the drawings, there is shown a basketball goal apparatus 10 constructed in accordance with the present invention. The basketball goal apparatus includes a backboard 11 and a basketball hoop 12 mounted thereto. The hoop 12 includes a rim portion 13 to which is secured, typically by welding, an upper support member 14 and a pair of lower support members 15 and 16. A basketball net 17 is secured to the rim portion 13 in the usual fashion.

Figure 4:
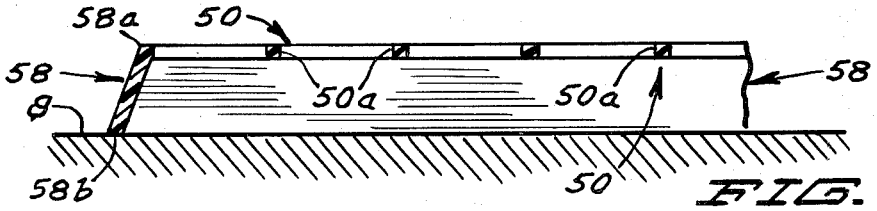
FIG. 4 is a perspective view of the basketball goal apparatus of FIG. 1, and particularly showing the apparatus following the shearing of the shear member and the transition of the goal into the second or collapsed position.
Figure 2:
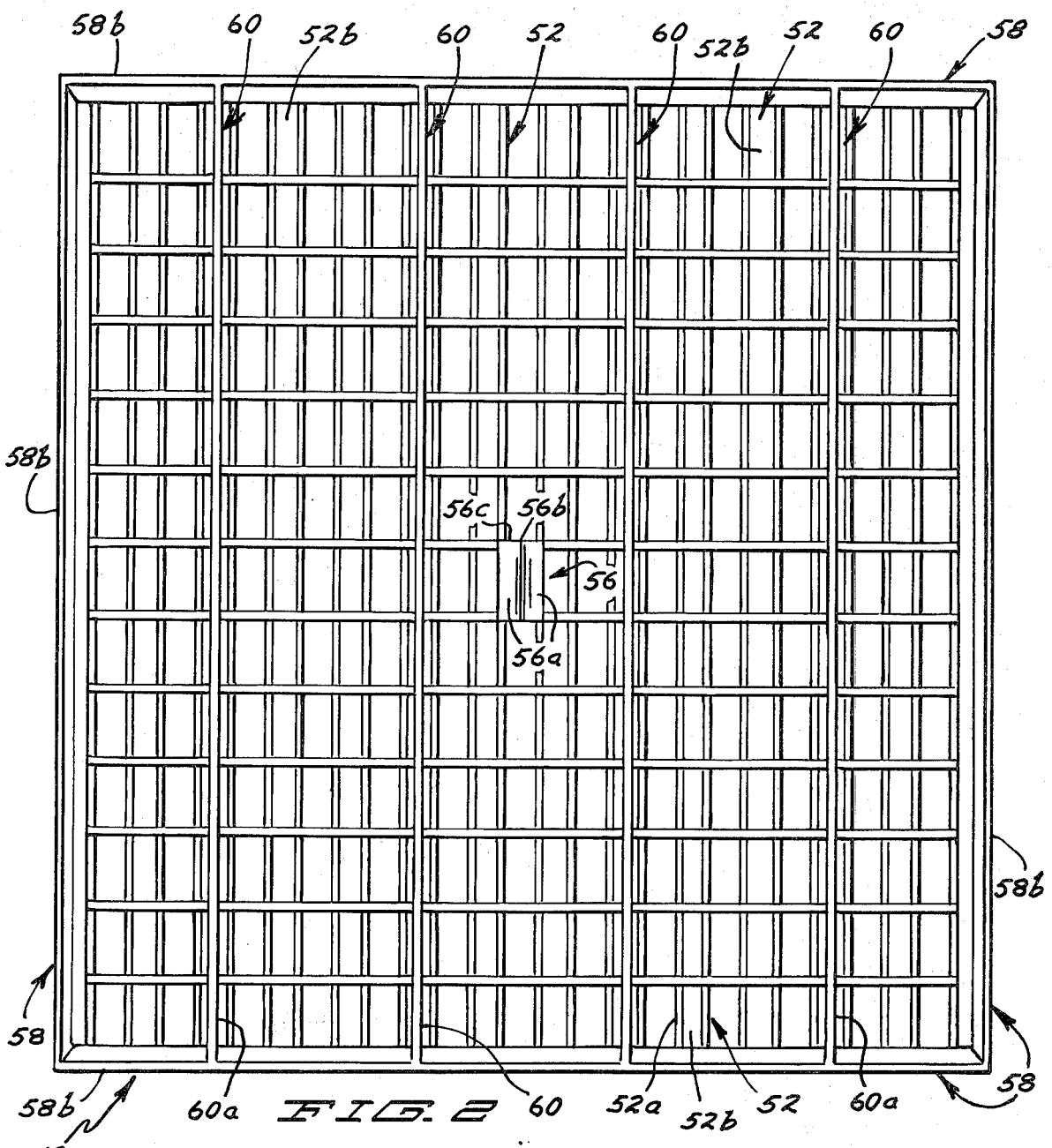
FIG. 2 is a side, elevational view, partially in cross section, of the basketball goal apparatus of FIG. 1.
Figure 5:
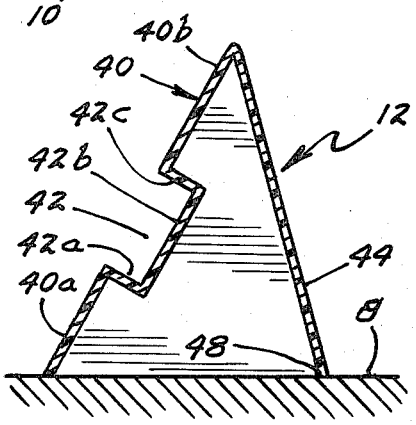
Figure 6:
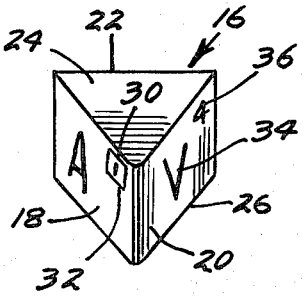
Figure 7:
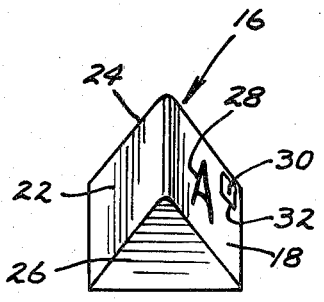
Figure 8:
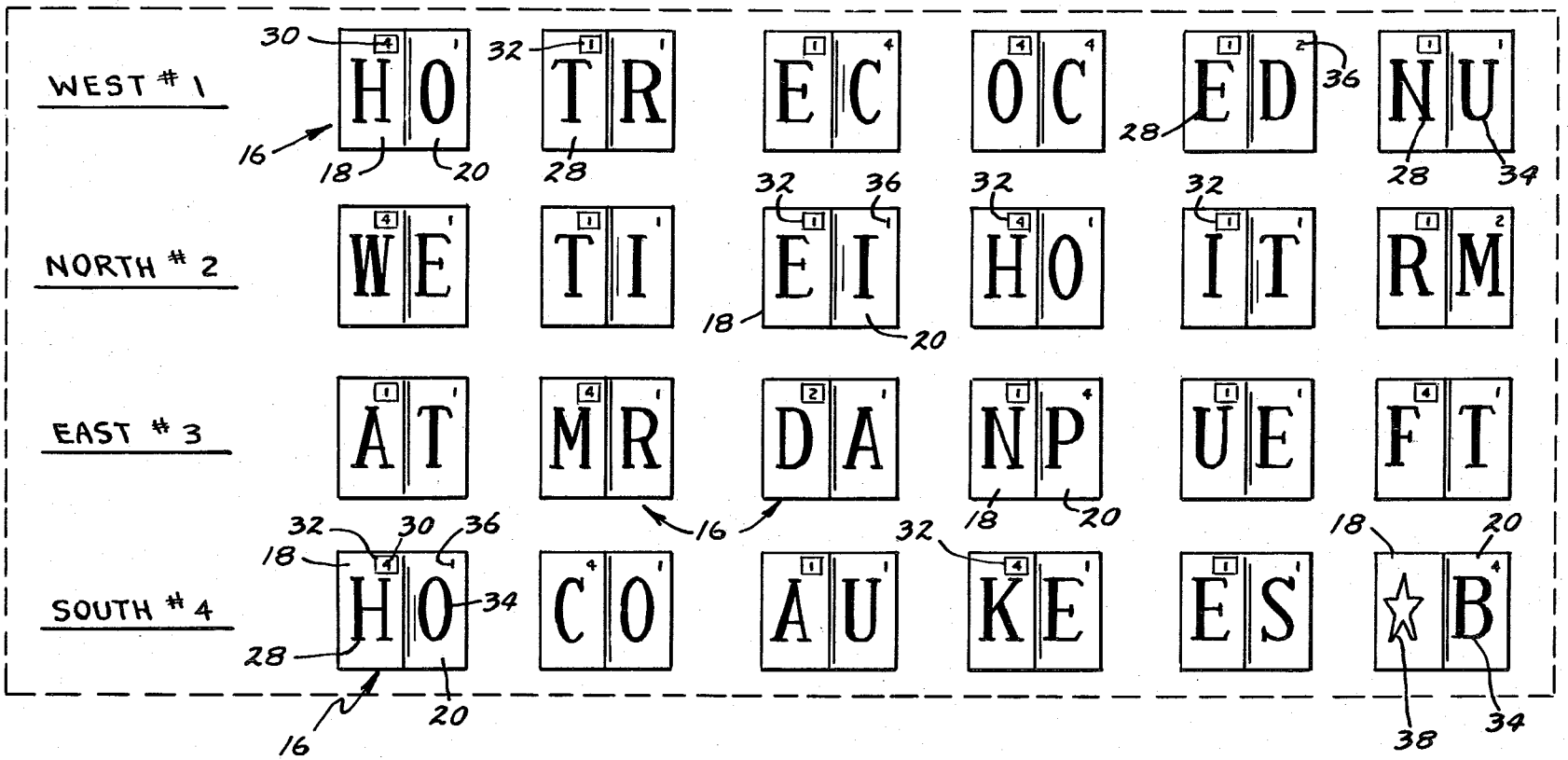
Figure 9:
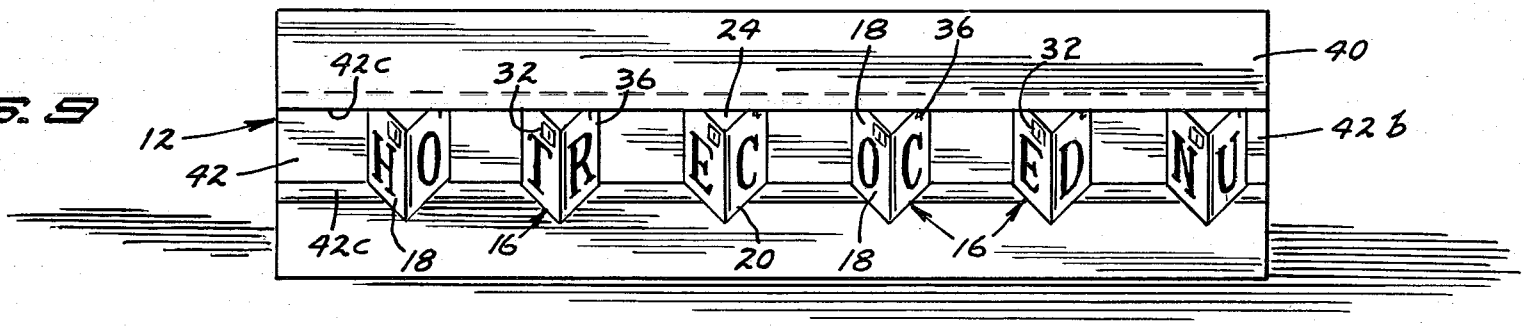
Figure 10:
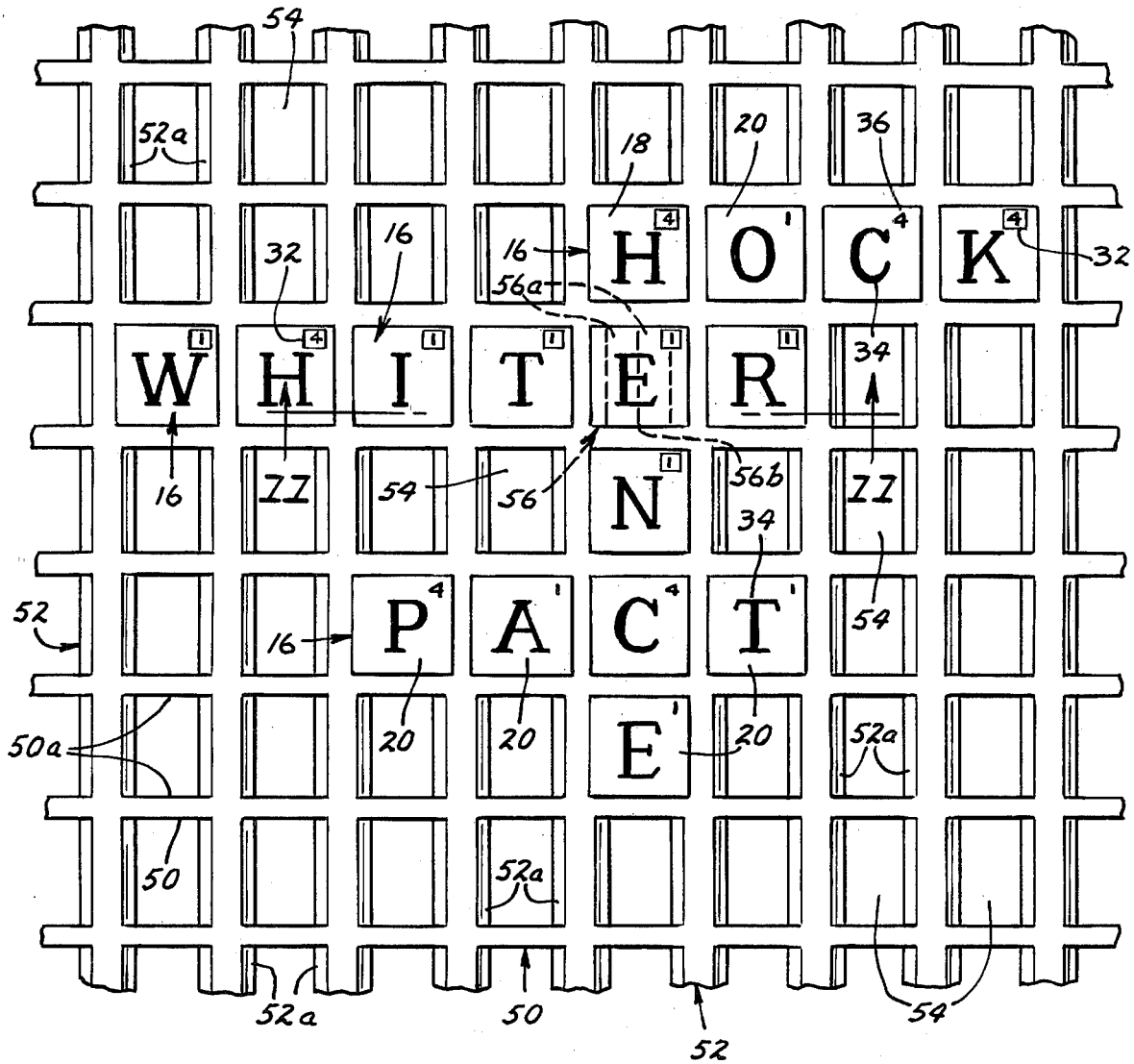
Figure 11:
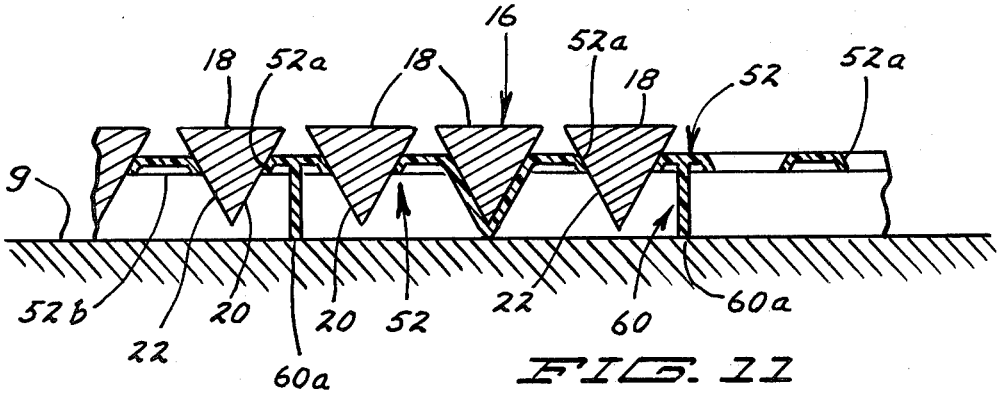
Figure 12:
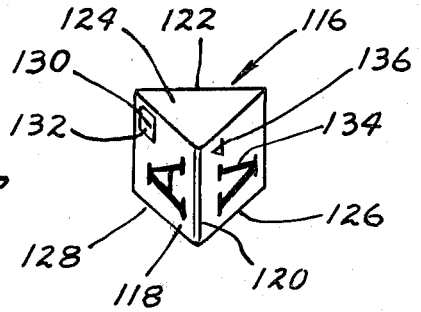
Figure 13:
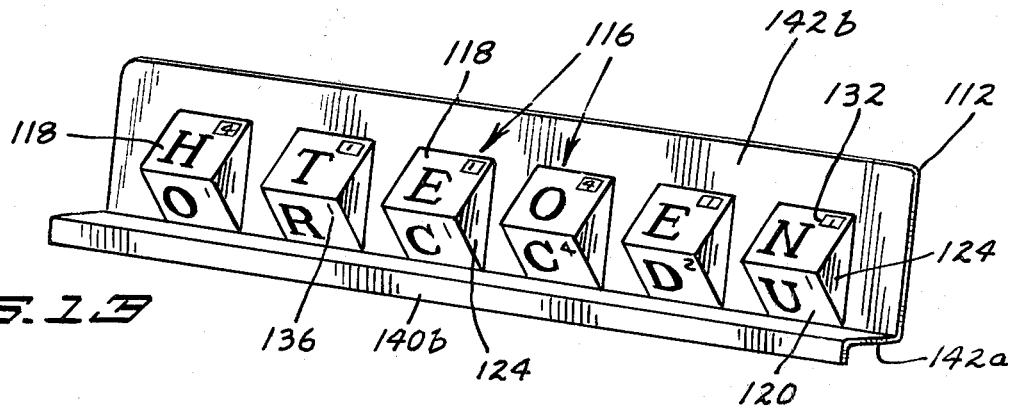
Figure 14:
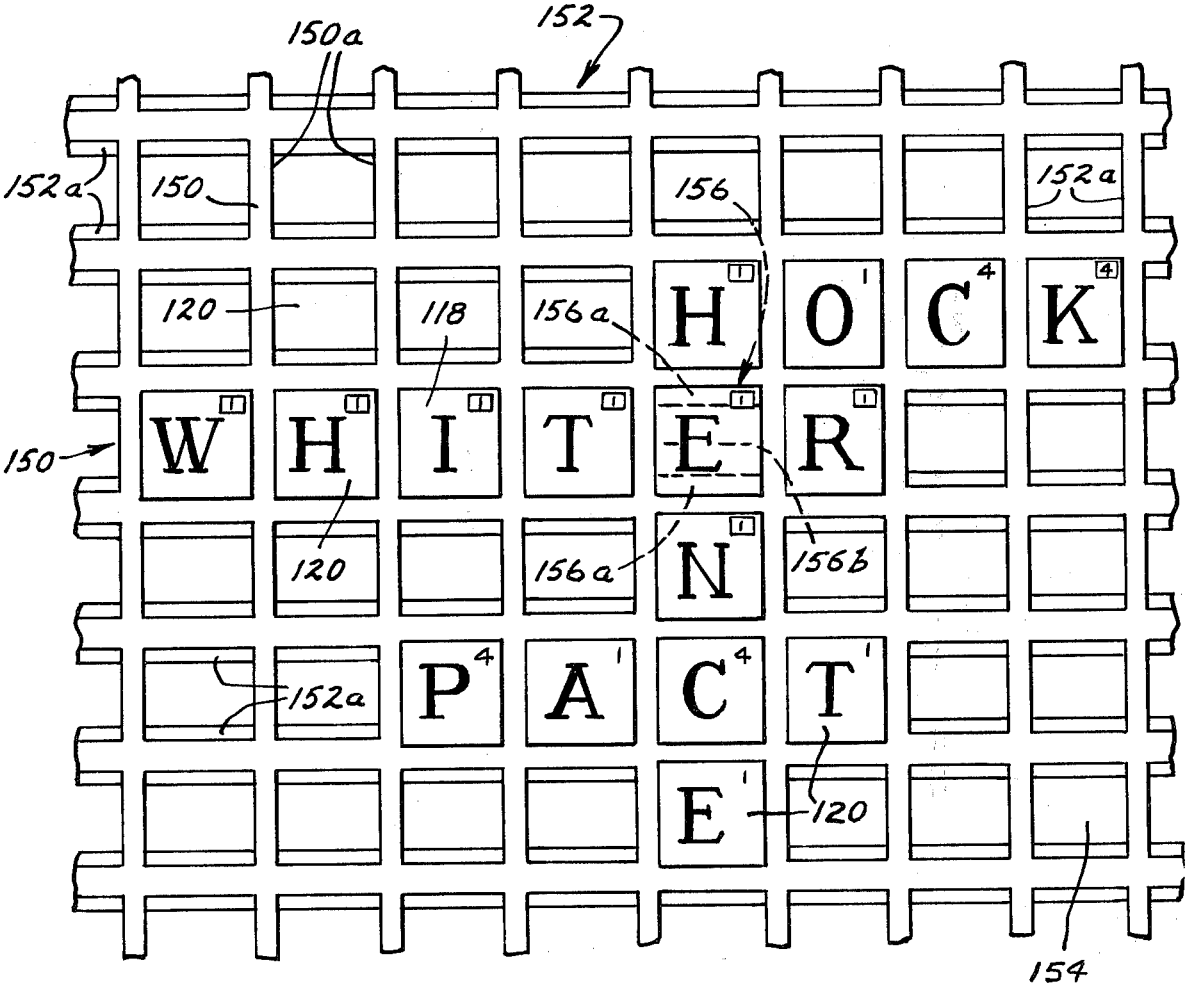
Figure 1:
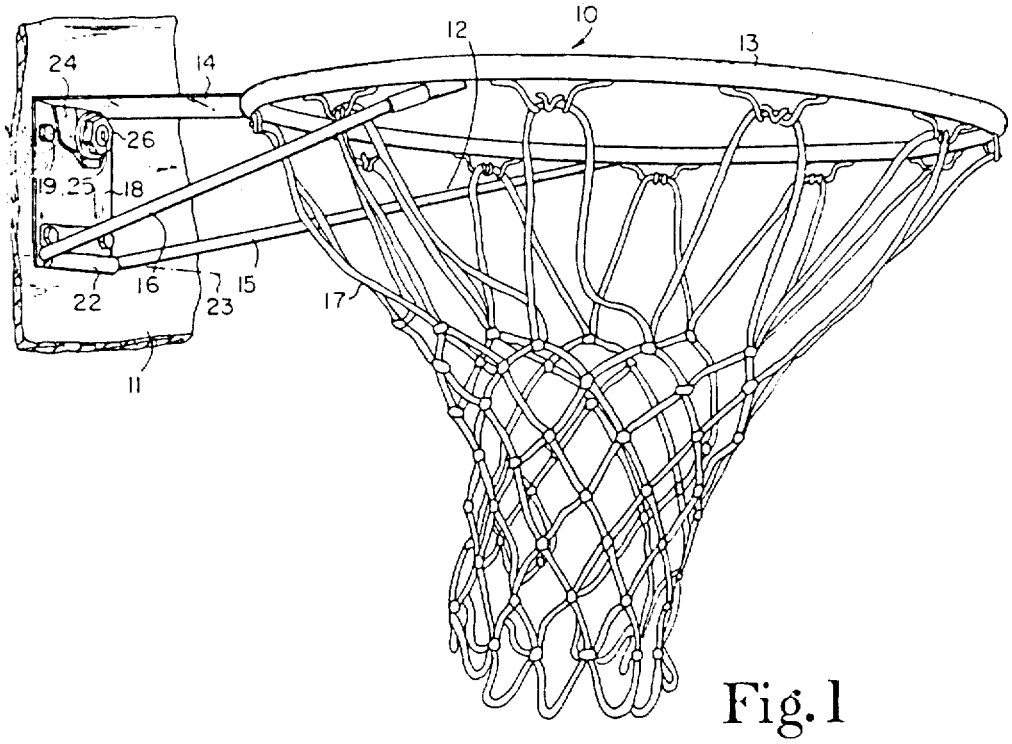
Figure 2:
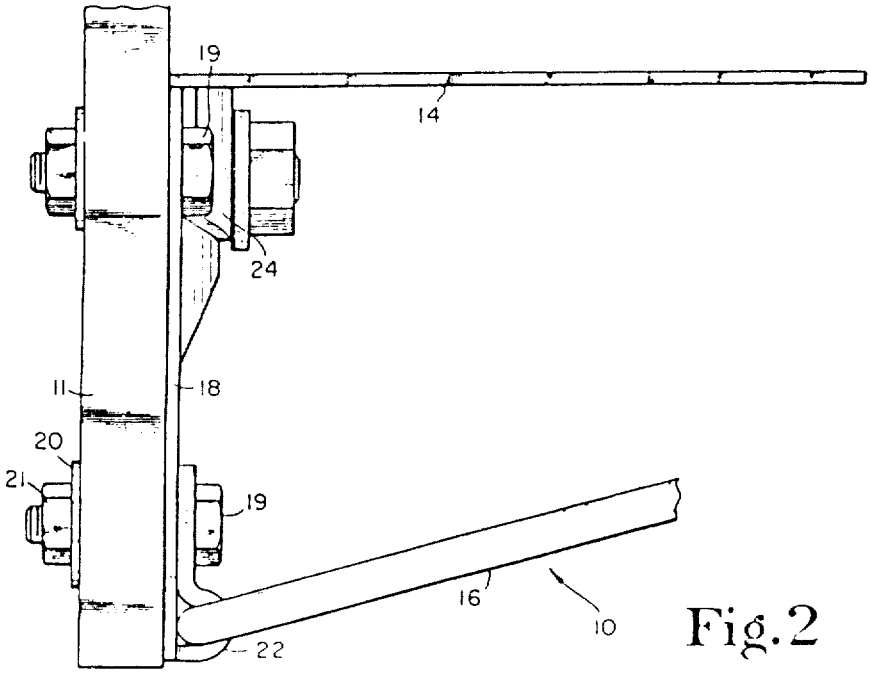
Figure 3:
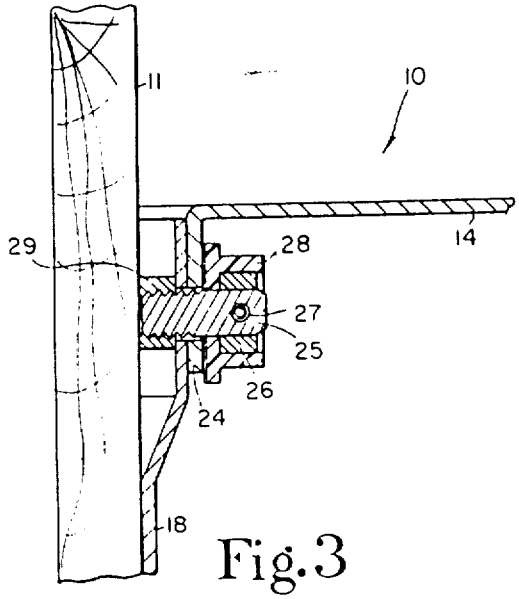
Figure 4:
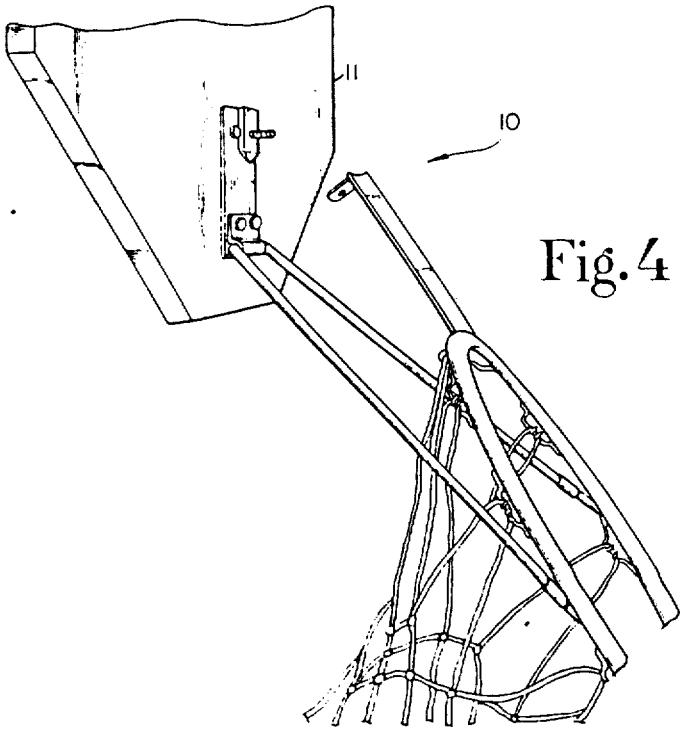

Mounting means are provided for mounting the basketball hoop 12 to the backboard 11 to have a first position with the hoop in a horizontal position, as shown in FIG. 1, and a second position with the hoop displaced downwardly from the first position as shown in FIG. 4. In the preferred embodiment, the mounting means includes a backboard bracket 18 secured to the backboard such as by bolts 19, washers 20 and nuts 21.

The lower support members 15 and 16 are pivotally mounted to the backboard bracket 18 to provide for pivoting about a horizontal axis at the lower part of the backboard bracket. Various means may be provided for such pivoting attachment. In the preferred embodiment, the lower support members 15 and 16 include inwardly extending portions, which may be connected, which are held against the backboard bracket 18 by means of a sleeve member 22. The sleeve member extends over the inwardly extending portions of the lower support members, and is secured to the backboard by means of the bolts 19 which also secure the backboard bracket to the backboard. It will be appreciated from the drawings that the basketball hoop 12 is pivotable downwardly about the axis 23, which extends through the center of the inwardly-extending portions of the lower support members, if or when the upper support bracket 14 is disconnected from the backboard bracket.

In the first position of the basketball hoop, the upper support member 14 is secured to the backboard bracket by the following attachment means. This attachment means is for attaching the upper support member to the backboard, and in the preferred embodiment to the backboard bracket, to provide for releasing the upper support member from the backboard bracket and for releasing the basketball hoop from the first position to the second position by the shearing of a shear member. Secured to or integral with the upper support member 14 is a hoop bracket 24. The hoop bracket 24 preferably has a generally concave configuration facing the backboard bracket, which backboard bracket similiarly has a convex portion facing the hoop bracket and shaped complementary therewith. This use of matching surfaces facilitates alignment of the mechanism and also provides additional lateral stability for the mounting structure.

A threaded post 25 is received through aligned apertures in the hoop bracket 24 and backboard bracket 18. A collar 26 is received over the outer end of the post 25, and both the collar and post include transverse apertures within which is received a shear member 27. A retainer 28 also is received over the post 25 and includes a recess within which the collar 26 is received. In this fashion, the retainer 28 will hold the shear member 27 in the apertures in the threaded post and collar.

As previously indicated, the post is then received through the apertures in the hoop bracket 24 and the backboard bracket 18. The rearward or threaded end portion of the post extends into the cavity defined by the convex portion of the backboard bracket. A nut 29 is threaded onto the post and upon tightening will draw the basketball hoop 12 firmly against the backboard bracket 18. Therefore upon mounting of the backboard bracket 18 to the backboard 11, there is provided a rigid and sturdy assembly of the basketball goal apparatus, and yet one which will pivot downwardly upon the shearing of the shear member 27 resulting from a substantial downward force applied to the basketball rim.

It will be appreciated that only the preferred embodiment of the present invention has been described, and there are many mechanical equivalents which could be used in the place of the various components described. It has previously been mentioned that various attachment means could be used to provide for the pivoting or hinged attachment of the hoop at the lower part of the backboard bracket. Similarly, modifications as to the attachment means providing for the use of a shear member to release the hoop upon the application of a sufficient force could also be employed. The preferred embodiment described herein is considered desirable since it provides a simple construction which may be readily adapted to existing types of basketball goals and backboards. The attachment to the backboard is substantially identical to that used in the vast majority of currently available basketball hoops. Unlike some of the prior art devices, there is no need according to the present invention to have substantial, if any, modifications to the backboard or to the method of attachment to the backboard.

The described embodiment for the attachment means is also considered desirable in that it provides a simple method for providing a firm connection of the hoop to the backboard bracket. Once the collar, shear member and retainer have been assembled onto the threaded post, the post is inserted through the aligned apertures in the hoop bracket and backboard bracket and the nut 29 is then tightly fastened thereto. This permits a simple replacement of the shear member after it has been sheared, and yet also provides for a sturdy connection of the hoop to the backboard.

Other modifications of the present invention also will become apparent to those skilled in the art. For example, rather than a single shear member shown extending in the horizontal plane, there could be several shear members and they could be oriented in vertical planes, horizontal planes, etc. A particularly preferred shear member is one known as SPIROL TM pin. The SPIROL TM pin is a flat band of material which has been coiled in approximately two circles. This coiling permits the pin to have some resiliency and to therefore absorb a certain amount of force simply by a tightening of the coil in response to the force. However, various other shear members could be used including the more typical shear pins which can be either solid or rolled pins. Also, the various members of the invention, and particularly including the shear member, may be made of a wide variety of materials according to the requirements for the intended use of the basketball goal. It is a particular feature of the present invention that the shear member may be selected, as desired, to have a shear force appropriate to the particular use of the basketball goal. This would have a significant impact, for example, where the strength of the backboard varies and the force which can therefore be absorbed by the backboard before it will fail will similarly vary.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A collapsible basketball goal apparatus which comprises:

a backboard adapted for mounting on a suitable support;

a basketball hoop adapted for carrying a basketball net;

mounting means for mounting said hoop to said backboard to have a first position with said hoop in a horizontal condition and a second position with said hoop displaced downwardly from the first position, said mounting means including a backboard bracket, a lower support member and an upper support member including an aperture, the backboard bracket being secured to said backboard, the lower support member being attached to said hoop and further being hingedly attached to the backboard bracket about a horizontal axis parallel with said backboard at a first location, the upper support member being attached to said hoop;

said mounting means further including an attachment means for attaching the upper support member to said backboard, the attachment means including a post member mounted to said backboard bracket extending perpendicularly from said backboard and received through the aperture in the upper support member, the post member including an aperture extending parallel with said backboard; and release means for releasing said hoop from the first position to the second position in response to a predetermined downward force upon said hoop, said release means including a shear member extending through the aperture in the post member and being positioned to be sheared by movement of said hoop from the first position to the second position upon application of the predetermined downward force, said release means being for releasing the upper support member from said backboard and for releasing said hoop from the first position to the second position by shearing of the shear member.

2. The apparatus of claim 1 in which said backboard bracket includes an aperture, the post member extending through the aperture in said mounting bracket.

3. The apparatus of claim 2 in which the post member includes a threaded portion and which includes a nut threaded onto the threaded portion of the post member, thereby securing the post member to the mounting bracket.

4. The apparatus of claim 2 and which further includes a collar received over the post member, said collar including an aperture and the shear member extending through the aperture in said collar.

5. The apparatus of claim 4 and which further includes a retainer member received over said collar and retaining the shear member within the apertures in said collar and the post member.

* * * * *

UNITED STATES PATENT AND TRADEMARK OFFICE

CERTIFICATE OF CORRECTION

PATENT NO. : 4,397,464

DATED : August 9, 1983

INVENTOR(S) : Frank Robert Krug

It is certified that error appears in the above-identified patent and that said Letters Patent is hereby corrected as shown below:

The title page and the sheets of drawing consisting of Figures 1 - 14 should be deleted to appear as per attached sheets.

Signed and Sealed this

*Twenty-sixth* Day of *March 1985*

[SEAL]

*Attest:*

DONALD J. QUIGG

*Attesting Officer* *Acting Commissioner of Patents and Trademarks*

United States Patent [19]

Krug

[11] 4,397,464

[45] Aug. 9, 1983

[54] COLLAPSIBLE BASKETBALL GOAL APPARATUS

[75] Inventor: Frank R. Krug, Newburgh, Ind.

[73] Assignee: Indian Industries, Inc., Evansville, Ind.

[21] Appl. No.: 299,295

[22] Filed: Sep. 3, 1981

[51] Int. Cl.[3] ..... A63B 63/08
[52] U.S. Cl. ..... 273/1.5 R
[58] Field of Search ..... 273/1.5 R; 248/548, 248/549; 172/271; 280/449; 180/14.5

[56] References Cited

U.S. PATENT DOCUMENTS

| | | | |
|---|---|---|---|
| 1,086,492 | 2/1914 | Weaver | 172/271 |
| 1,090,134 | 3/1914 | Caughey | 172/271 |
| 1,207,146 | 12/1916 | Dickinson | 172/271 |
| 2,381,973 | 8/1945 | Ego | 172/271 |
| 3,603,588 | 9/1971 | Ebstein | 273/1.5 R |
| 4,111,420 | 9/1978 | Tyner | 273/1.5 R |
| 4,194,734 | 3/1980 | Tyner | 273/1.5 R |

OTHER PUBLICATIONS

Slam Dunk Rim, Inc. Advertising Circular #2 Pop Bolt 4–1978.
Western Front 9–1977 Slam Dunk Rim.

*Primary Examiner*—Paul E. Shapiro
*Attorney, Agent, or Firm*—Woodard, Weikart, Emhardt & Naughton

[57] ABSTRACT

A collapsible basketball goal apparatus is disclosed herein which includes a backboard and a basketball hoop mounted to the backboard. The hoop is mounted to the backboard to be pivotable about a horizontal axis parallel with the backboard between a first, horizontal position and a second, downwardly-displaced position.

A post extends perpendicularly outward from the backboard and defines an aperture extending parallel to the backboard. An upper support is secured to the hoop and defines a hole in which the post is received in the first position. A shear member is positioned in the aperture of the post and is located to be sheared upon application of a downward force on the hoop which urges the upper support member away from the backboard to shear the member.

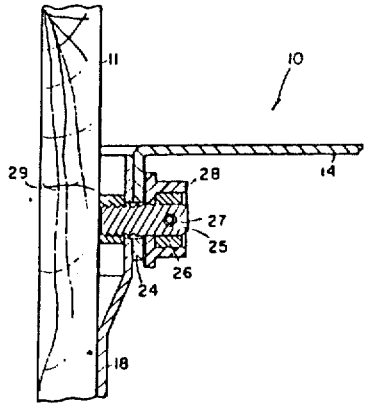

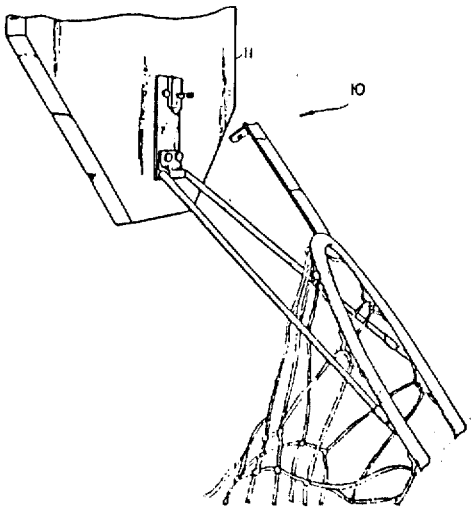

5 Claims, 4 Drawing Figures